US008042278B2

(12) United States Patent
Lüttgens

(10) Patent No.: US 8,042,278 B2
(45) Date of Patent: Oct. 25, 2011

(54) COMPASSES WRITING IMPLEMENT

(76) Inventor: Fritz Lüttgens, Erlangen (DE)

( * ) Notice: Subject to any disclaimer, the term of this patent is extended or adjusted under 35 U.S.C. 154(b) by 41 days.

(21) Appl. No.: 12/635,162

(22) Filed: Dec. 10, 2009

(65) Prior Publication Data

US 2010/0139104 A1 Jun. 10, 2010

(30) Foreign Application Priority Data

Dec. 10, 2008 (DE) ..... 20 2008 016 339 U

(51) Int. Cl.
*B43L 9/02* (2006.01)

(52) U.S. Cl. ..... 33/27.02; D19/38

(58) Field of Classification Search ..... 33/18.1, 33/18.2, 27.01, 27.02, 27.031, 27.06; D19/38, D19/41–43, 54–58
See application file for complete search history.

(56) References Cited

U.S. PATENT DOCUMENTS

| | | | | |
|---|---|---|---|---|
| 1,611,835 | A * | 12/1926 | Keaney | 33/27.02 |
| 1,674,726 | A * | 6/1928 | Keaney | 33/27.02 |
| 1,734,958 | A * | 11/1929 | Audrieth | 33/27.02 |
| 2,017,737 | A * | 10/1935 | Smith | 33/27.02 |
| 2,573,760 | A * | 11/1951 | Cherne | 33/27.02 |
| 2,637,906 | A * | 5/1953 | Giossi | 33/27.02 |
| 2,718,703 | A * | 9/1955 | Chilcote | 33/27.02 |
| 2,941,511 | A * | 6/1960 | Cieremans | 401/116 |
| 3,550,282 | A * | 12/1970 | Tsunemi | 33/27.02 |
| 3,797,117 | A | 3/1974 | Gimenez | |
| 3,825,976 | A * | 7/1974 | Moore | 24/11 F |
| 6,871,406 | B1 * | 3/2005 | Elia et al. | 33/27.02 |
| 7,640,671 | B1 * | 1/2010 | Tu | 33/27.02 |

FOREIGN PATENT DOCUMENTS

| | | |
|---|---|---|
| DE | 335 280 | 3/1921 |
| DE | 1847774 U | 3/1962 |
| DE | 2 234 274 | 2/1973 |
| DE | 7136753 U | 3/1973 |

* cited by examiner

*Primary Examiner* — Amy Cohen Johnson
(74) *Attorney, Agent, or Firm* — Laurence A. Greenberg; Werner H. Stemer; Ralph E. Locher

(57) ABSTRACT

A compass writing implement includes a compass body having two compass legs mutually pivotable between closed and splayed-out states. A writing lead is mounted in one of the compass legs. A protective cap is or can be fitted onto the free end of at least the compass leg holding the writing lead, to shield the free ends of the two compass legs in the closed state from the outside. The protective cap has a passage for the writing lead at a distal end remote from the compass body in the fitted state. The writing lead and the fitted protective cap are mutually displaceable between a release state and a retention state. In the release state, a lead tip of the writing lead protrudes through the passage of the protective cap to the outside and in the retention state, the writing lead is retracted in the interior of the protective cap.

12 Claims, 8 Drawing Sheets

COMPASSES WRITING IMPLEMENT

CROSS-REFERENCE TO RELATED APPLICATION

This application claims the priority, under 35 U.S.C. §119, of German Patent Application DE 20 2008 016 339.0, filed Dec. 10, 2009; the prior application is herewith incorporated by reference in its entirety.

BACKGROUND OF THE INVENTION

Field of the Invention

The invention relates to a compass writing implement.

A compass writing implement is referred to below as an implement that can be used, on one hand, in the manner of a pencil for writing and, on the other hand, can also be used as a pair of legs for drawing circular lines. A compass writing implement is known, for example, from German Utility Model DE 71 36 753 U. That writing implement includes a compass body with a holder on which two compass legs are pivotably mounted. The compass legs, as is generally common in the case of pairs of legs, can be pivoted one relative to the other between a closed state, in which the compass legs abut against each other in a parallel position, and a splayed-out state, in which the compass legs form an adjustable angle. A writing lead is mounted on one of the compass legs. The other compass leg bears a compass tip. The known compass writing implement also includes a protective cap that can be slipped over the two compass legs in such a manner that it secures the same in the closed state. For writing purposes, the known compass writing implement includes an additional writing lead which is integrated in the holder of the compass body and which, in a writing mode, projects at the free end of the holder remote from the compass legs.

Another compass writing implement is known from German Published, Non-Prosecuted Patent Application DE 2 234 274 A, corresponding to U.S. Pat. No. 3,797,117. That compass writing implement also has two compass legs that are pivotable one relative to the other and one of the compass legs holds a ballpoint pen cartridge in a fixed manner. That compass leg basically has an outer contour that corresponds to a conventional ball point pen. Contrary to a conventional ballpoint pen, however, a longitudinal groove is provided in the circumference of the compass leg, into which longitudinal groove the second compass leg is pivotable in the closed state.

Yet another compass writing implement is known from German Published, Non-Prosecuted Patent Application DE 335 280 A. In the case of that compass writing implement, in order to use the writing implement as a pencil, the compass legs are not pivoted into the closed state, but into a state in which the compass legs are aligned with one another in a straight line and, at the same time, in axial extension together form the pencil body.

A pair of legs with a protective cap that can be fitted onto the free ends of the two compass legs in order to protect their free ends from damage, is also known from German Utility Model DE 18 47 774 U.

SUMMARY OF THE INVENTION

It is accordingly an object of the invention to provide an improved compass writing implement, which overcomes the hereinafore-mentioned disadvantages of the heretofore-known devices of this general type and which, in particular, is especially simple to manage.

With the foregoing and other objects in view there is provided, in accordance with the invention, a compass writing implement, comprising a compass body including two compass legs having free ends and being mounted pivotably relative to one another between a closed state and a splayed-out state, a writing lead held on one of the compass legs and having a lead tip, and a protective cap fitted or to be fitted onto the free end of at least the compass leg holding the writing lead for shielding at least the free end from the outside in the closed state. The protective cap has an interior, a distal end remote from the compass body in a fitted state and a passage in the distal end for the writing lead. The writing lead and the fitted protective cap are displaceable relative to one another between a release state in which the lead tip of the writing lead projects through the passage to the outside, and a retention state in which the writing lead is retracted in the interior of the protective cap.

Accordingly, the compass writing implement, which is also referred to below in brief, without loss of generality, as a "compass pencil," has a compass body with two compass legs mounted so as to be pivotable one relative to the other. The compass legs, in this case, are pivotable between a closed state (abutting against each other) and a state in which they are splayed apart (by an adjustable angle). A writing lead is mounted in this case on one of the compass legs. The compass pencil also includes an, in particular tapering, protective cap. The protective cap can be fitted (in the removed state) or is fitted (in the fitted state) onto the free end of that compass leg which holds the writing lead, in such a way that in the fitted state, the protective cap protects the free ends of the compass legs that abut together in the closed position from the outside.

According to the invention, the protective cap is provided at a distal end with a passage for the writing lead. A distal end of the protective cap refers in this case to that end which in the fitted state is remote from the compass body. In addition, the writing lead and the protective cap fitted onto the compass body are displaceable one relative to the other in such a manner that, in a release state, a lead tip of the writing lead projects through the passage of the fitted protective cap to the outside, and that, in a retention state, the writing lead is retracted in the interior of the protective cap. The writing lead is preferably a ballpoint pen cartridge or a lead produced from an abrasive material (writing lead, crayon lead or similar). In principle, however, any other arbitrary types of lead or cartridge, in particular felt or fiber, can be used.

When not being used, that is in particular for transport and for storage, the compass pencil is used normally with the protective cap fitted, in which state the writing lead is concealed in the retention state within the protective cap, and consequently damage to the writing lead or inadvertent contamination of the environment by the writing lead is ruled out. For the compass mode, the compass pencil is used normally with the protective cap removed in such a way that the free ends of both compass legs are accessible from outside and consequently the compass writing implement can be used in the manner of an ordinary pair of legs. The same writing lead is used normally for the writing mode as for the compass mode. In this case, the writing implement is used normally but once again with the protective cap fitted, with the writing lead for this purpose being displaced into the release state, that is to say pushed through the passage in the protective cap.

Due to the relative displaceability of the protective cap and of the writing lead, the compass pencil with the protective cap fitted can be operated with the same ease and precision as a conventional ballpoint pen or mechanical pencil. At the same time, it is particularly easy to convert the compass pencil from the writing function to the compass function simply by removing the protective cap. Using the same writing lead both for the writing mode and for the compass mode achieves particularly simple manageability, in particular also because the compass pencil does not have to be turned the other way up for these two types of use. At the same time, this also simplifies the manufacturing of the compass pencil and makes for a particularly compact construction of the compass pencil.

It is important for the above-described functioning of the compass pencil, in particular, that the writing lead is mounted, even with the protective cap removed, on the associated compass leg, i.e. secured in a fixed or at least radially fixed manner in such a way that the compass pencil can be used even when the protective cap has been removed. In other words, if need be, an additional support and guiding function for the writing mode is provided by the protective cap.

In accordance with another feature of the compass pencil of the invention, in the fitted state, the protective cap, at least in the axial direction of the compass body, is mounted, in particular locked, in a fixed manner on the compass body. In order to adjust the compass pencil between the release state and the retention state, in this case, the writing lead, also and even with the protective cap placed on, is guided so as to be displaceable in the associated compass leg. In order to displace the writing lead, a feed mechanism for the writing lead is integrated for this purpose in an expedient manner in the associated compass leg. In so far as the writing lead is a ballpoint pen cartridge, the feed mechanism is realized in an expedient manner in the manner of a conventional ballpoint pen mechanism. This can be realized in the manner of the "push-push mechanism" widely used in the case of ballpoint pens, where the writing lead is locked in an advanced position simply by actuating an actuating member, and is unlocked by actuating the same again in the same direction. For reasons of greater simplicity, for advancing a ballpoint pen cartridge a "push-rest mechanism" is also used as an alternative to this, where the ballpoint cartridge is displaced into the advanced position through the use of a slider and is locked in this position, and wherein for resetting the ballpoint pen cartridge, the locking is released at a separate location. In so far as the writing lead, as an alternative to this, is formed by a pencil or crayon lead, the feed mechanism is realized expediently in the manner of the feeding mechanism of a mechanical pencil or fine tip pen. In all cases the feed mechanism is expediently provided with an actuating member that protrudes to the outside on the circumference of the associated compass leg, i.e. on a radial outer wall of the same.

In accordance with a further feature of the compass pencil of the invention, the protective cap is lockable in the fitted state between two axial longitudinal displacement positions on the compass body. The longitudinal displacement positions correspond to the release state or the retention state. In this embodiment, the writing lead is expediently, but not necessarily, held in a fixed manner on the associated compass leg.

In accordance with an added feature of the compass pencil of the invention, the protective cap can be fitted or is fitted onto the free ends of the two compass legs in such a manner that the compass legs are secured by the protective cap in their closed state. The compass legs are consequently secured against inadvertently splaying out through the use of the protective cap, in particular for the purposes of storage and transport.

In accordance with an additional, alternative feature of the compass pencil of the invention, the protective cap can simply be fitted directly onto that compass leg which bears the writing lead. On the side facing the other compass leg, the protective cap in this case is provided with a longitudinal groove or a notch, through which that compass leg can be passed. In this embodiment, the free end of the additional compass leg in the closed state is also within the protective cap and is consequently reliably protected against contact from the outside. At the same time, however, it is possible to splay the compass legs apart without removing the protective cap.

In accordance with yet another feature of the compass pencil of the invention, for particularly good manageability of the compass pencil in writing mode, it is advantageously provided that the writing lead is located in such a manner in the associated compass leg that in the closed state of the compass legs, it is oriented substantially coaxially to the (longitudinal) axis of the compass body, and consequently substantially centrally to the same.

In accordance with yet an added feature of the compass pencil of the invention, for simplified handling of the compass pencil in compass mode, it is preferably provided additionally or alternatively hereto that the compass legs are coupled together in such a manner that the two compass legs are only able to be splayed out in each case in a symmetrical manner by identical angles from the (longitudinal) axis of the compass body. Such a coupling mechanism is known per se, for example, from German Utility Model DE 71 36 753 U.

In accordance with yet an additional feature of the compass pencil of the invention, once again for improved manageability of the compass pencil in writing mode, the compass legs are shaped in an expedient embodiment in such a manner that they, together with the fitted protective cap, form an ergonomically rounded outer contour, substantially in the manner of an elongated oval or in the manner of a spheroid. In addition to or as an alternative thereto, the protective cap can be provided with ergonomically shaped recessed grips for the fingers of a hand holding the compass pencil.

In accordance with a concomitant feature of the compass pencil of the invention, a securing clip that points to the compass body is mounted, in particular integrally formed, on the protective cap. Through the use of the securing clip, the compass pencil can be secured in a pocket, for example on the clothes of a user or in a briefcase. As an alternative, such a bracket can also be mounted, in particular integrally formed, on one of the compass legs or on a holder holding the same, and then preferably points to the free end of the compass legs.

Other features which are considered as characteristic for the invention are set forth in the appended claims.

Although the invention is illustrated and described herein as embodied in a compass writing implement, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
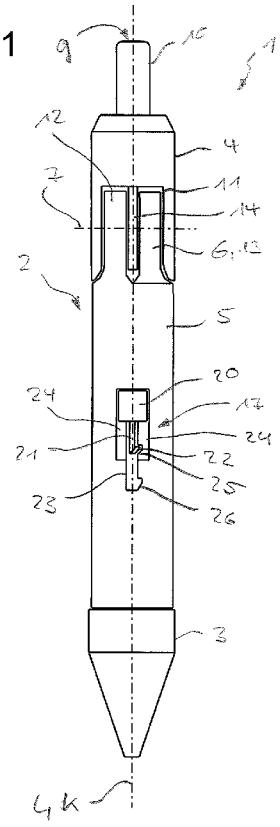
FIG. 1 is a diagrammatic, side-elevational view of a first embodiment of a compass pencil with a compass body including a holder and two compass legs, and with a protective cap fitted onto the compass legs in their closed position, with a writing lead held in one of the compass legs being concealed in a retention state within the protective cap.

Referring now in detail to the figures of the drawings, in which identical reference numerals are always provided in all of the figures for parts that correspond to one another, and first, particularly, to FIG. 1 thereof, there is seen a compass pencil 1 which is represented in a first embodiment initially in FIGS. 1 to 11 and includes an elongate compass body 2 and a protective cap 3. The compass body 2, in turn, includes a holder 4 and two compass legs 5 and 6, which are mounted on the holder 4 so as to be pivotable about an axis 7. The compass legs 5 and 6, in this case, are pivotally mounted on the holder 4 through the use of a securing screw 8 that is guided coaxially relative to the axis 7.

The holder 4 is produced, in particular, as an injection molded part or die cast part made from plastics material, aluminum or magnesium and is drawn out at its free end 9 remote from the compass legs 5 and 6 to form a pencil-shaped grip projection 10. Opposite the free end 9, the holder 4 is provided with a receiving device 11 which, when seen in a top view as in FIG. 1, is approximately U-shaped with walls which are oriented transversely to the axis 7, and in which the compass legs 5 are inserted in each case by way of a pivot joint projection 12, 13. A partition 14, which is guided on the holder 4 so as to be longitudinally displaceable but non-rotatable, is located between the pivot joint projections 12 and 13. By engaging the pivot joint projections 12 and 13 in corresponding guide ways of the partition 14, the compass legs 5 and 6 are coupled together in such a manner that they are always only capable of being pivoted out in a symmetrical manner by identical angles with reference to a longitudinal axis L of the compass body 2. The principle of a corresponding coupling mechanism is disclosed, for example, in German Utility Model DE 71 36 753 U.

The compass legs 5 and 6, in turn, are preferably formed as hollow shaped parts made from plastics material, aluminum or magnesium. The compass leg 5, in this case, is for holding a writing lead 15, which in the example represented is a conventional ballpoint pen cartridge. The compass leg 6 is used for holding a compass tip 16 made of steel.

Both the writing lead 15 and the compass tip 16 are guided so as to be displaceable in the respective compass leg 5 and 6 and can be secured through the use of a corresponding fixing device in various longitudinal displacement positions with reference to the respective compass leg 5 or 6. In the case of the writing lead 15, the fixing device is formed by a ballpoint pen mechanism 17 constructed in the manner of a "push-rest mechanism." The ballpoint pen mechanism 17 includes a sleeve 18 provided with a blind bore hole and fitted onto a rear end of the writing lead 15. The sleeve 18 is connected through the use of an integrally molded connecting web 19 to a slider 20 that protrudes partially on the outer circumference of the compass leg 5. A spring arm 21, which has a locking hook 22 at its free end, is also mounted, in particular integrally formed in one piece, on the connecting web 19.

The connecting web 19 is guided so as to be displaceable along the longitudinal axis L in an elongate hole 23 that is formed into the wall of the compass leg 5. Indentations 24 are provided in the outer wall of the compass leg 5 over a partial region of the length of the elongate hole 23 on both sides of the same. The indentations act as a bed for the slider 20.

Two recesses 25 and 26 are provided in the elongated hole 23 at the side of the same. The locking hook 22 locks into the recesses in various displacement positions of the slider 20.

A compressed spiral spring 27 is also a component part of the ballpoint pen mechanism 17 and pretensions the writing lead 15 in the direction of the sleeve 18. The compressed spiral spring 27 surrounds the writing lead 15 and is supported between the compass leg 5 and two radial embossings 28 of the writing lead 15.

The compass tip 16 is securable so as to be reversible on the compass leg 6 through the use of a securing screw 29. The securing screw 29, in this case, mates with an associated threaded bore that is provided in the wall of the compass leg 6.

The protective cap 3 is realized as a shaped part, in particular as an injection molded component made of plastics material. It is substantially in the form of a tapered sleeve. The protective cap 3 is provided with a comparably wide top opening 30 (FIG. 9) at one of its axial ends. At the oppositely situated axial end (hereafter referred to as distal end 32), the protective cap 3 has a narrow passage 33 that is located concentrically to a cap axis K.

FIGS. 1 to 9 show the compass legs 5 and 6 of the compass pencil 1 in a closed state, in which the compass legs 5 and 6 abut against each other parallel to the longitudinal axis L. The compass legs 5 and 6 together with the holder 4, in this case, form a substantially pencil-shaped, preferably approximately circular cylindrical outer contour (see FIG. 7). As is clear from FIGS. 3, 6 and 7 in particular, in this case, the compass leg 6 is provided on its inner wall with an approximately semi-cylindrical recess, into which the compass leg 5 extends by way of a substantially complementarily formed projection 34 (see FIGS. 10 and 11). The writing lead 15 lies in the projection 34 in the interior of the compass leg 5 in such a manner that the writing lead 15, in the closed position of the compass legs 5 and 6, is oriented co-linearly with the longitudinal axis L. This means that the writing lead 15 is located, in particular, centrally with reference to the outer contour formed by the closed compass legs 5 and 6.

The protective cap 3 is fitted onto free ends 35 and 36 (FIGS. 8 and 9) of the compass legs 5 or 6 in such a manner that, in the fitted state, it protects the free ends 35 and 36 from the outside. In this case, in the fitted state, the protective cap 3 also secures the compass legs 5 and 6 in their closed position and consequently prevents the compass legs 5 and 6 from inadvertently splaying open.

The compass tip 16 is concealed in the interior of the protective cap 3 with the protective cap 3 fitted in place. To this end, the compass tip 16 is inserted into the compass leg 6 in such a manner that it only extends out of the compass leg in a negligible manner.

Figure 2:
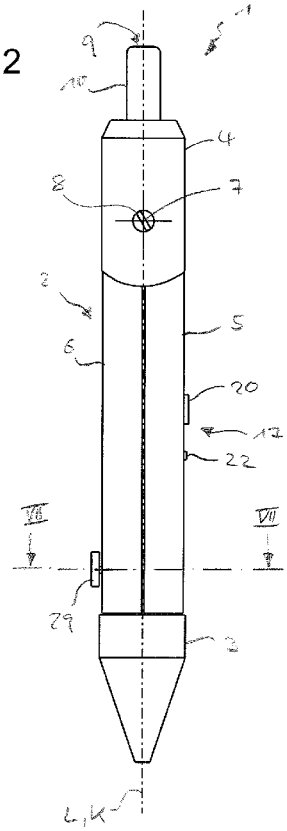
FIG. 2 is a side-elevational view of the compass pencil in the state shown in FIG. 1, rotated by 90°.
Figure 3:
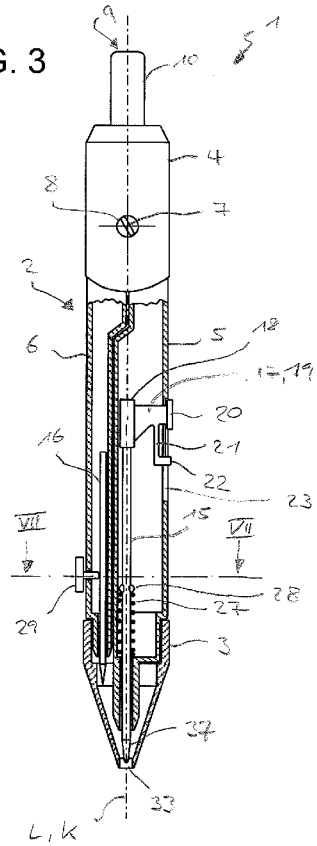
FIG. 3 is a partially broken-away and longitudinal-sectional view of the compass pencil in the orientation shown in FIG. 2.
Figure 4:
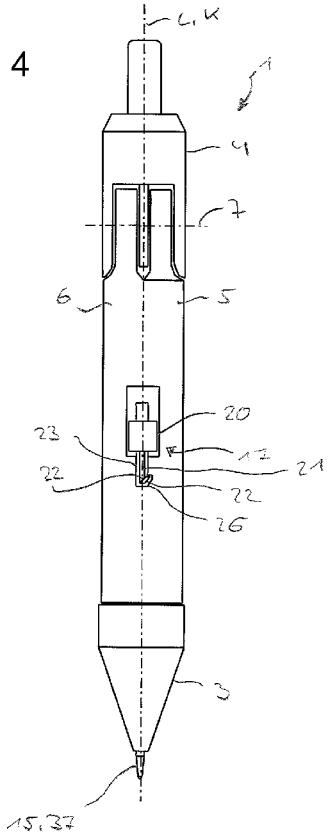
FIG. 4 is a view similar to FIG. 1 of the compass pencil shown in FIG. 1, with the writing lead being displaced into a release state in which it protrudes out of the fitted protective cap.
Figure 5:
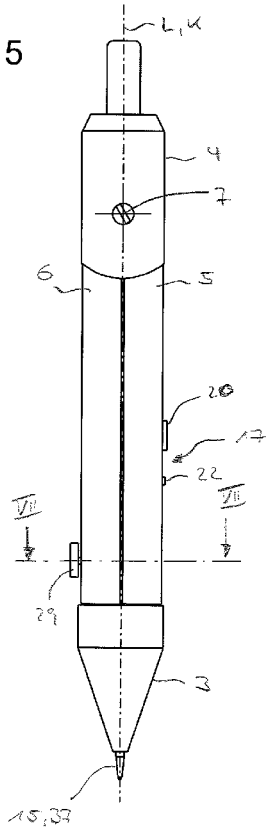
FIG. 5 is a view of the compass pencil in the state shown in FIG. 4, but in the representation shown in FIG. 2.
Figure 6:
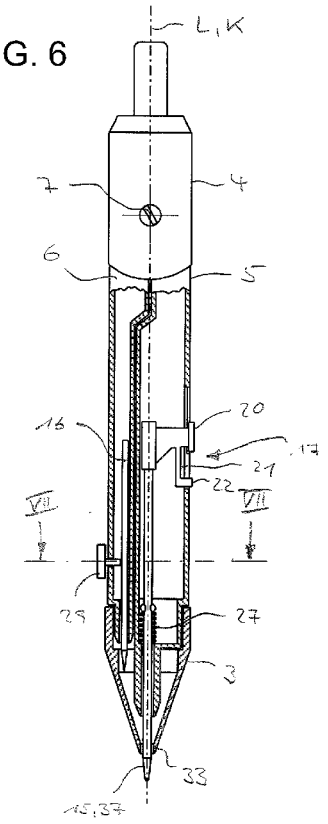
FIG. 6 is a view of the compass pencil in the state shown in FIG. 4, but in the representation shown in FIG. 3.
Figure 7:
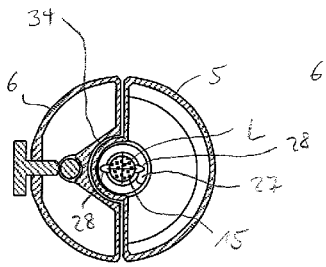
FIG. 7 is a cross-sectional view of the compass pencil shown in FIG. 1, which is taken along the line VII-VII in FIGS. 2, 3, 5 and 6, in the direction of the arrows.

The protective cap 3 is fitted onto the free ends 35 and 36 of the compass legs 5 and 6 in such a manner that its cap axis K is aligned with the longitudinal axis L of the compass body 3. In the fitted state, the protective cap 3, in this case, is located in such a manner with reference to the compass leg 5 and to the writing lead 15 held in the compass leg, that by actuating the ballpoint pen mechanism 17, the writing lead 15 can be displaced between a release state, in which the writing lead 15 extends through the passage 33 of the protective cap 3 to the outside by way of a lead tip 37, and a retention state, in which the writing lead 15 is totally concealed in the fitted protective cap 3. FIGS. 1 to 3 show the compass pencil 1 in the retention state of the writing lead 15, with the compass legs 5 and 6 in the closed position and the protective cap 3 fitted. FIGS. 4 to 6 show the compass pencil 1 in the release state of the writing lead 15, likewise with the compass legs 5 and 6 in the closed position and the protective cap 3 fitted.

The compass pencil 1 is held in the retention state as in FIGS. 1 to 3, in particular for the purposes of storage and transport, that is to say whenever the compass pencil 1 is not being used. In contrast, the compass pencil 1 is then moved into the release state when the compass pencil 1 is to be used for writing in the manner of a conventional ballpoint pen. In order to move the writing lead 15 into the release state, the slider 20 is displaced out of the position represented in FIGS. 1 to 3 in the direction of the protective cap 3, until the locking hook 22 locks in the recess 26 of the elongated hole 23 (FIGS. 4 to 6). In order to reset the writing lead 15 into the retention state, the locking hook 22 is manually pivoted out in a tangential manner by resiliently deforming the spring arm 21 until it unlocks from the recess 26. The writing lead 15 is then reset into the retention state, as in FIGS. 1 to 3, through the use of the compressed spiral spring 27.

Figure 8:
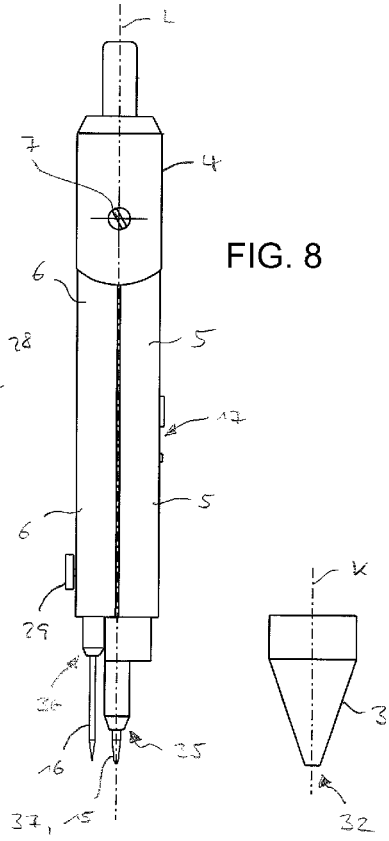
FIG. 8 is a view of the compass pencil shown in FIG. 1 in the representation and state shown in FIG. 2, but with the protective cap removed.
Figure 9:
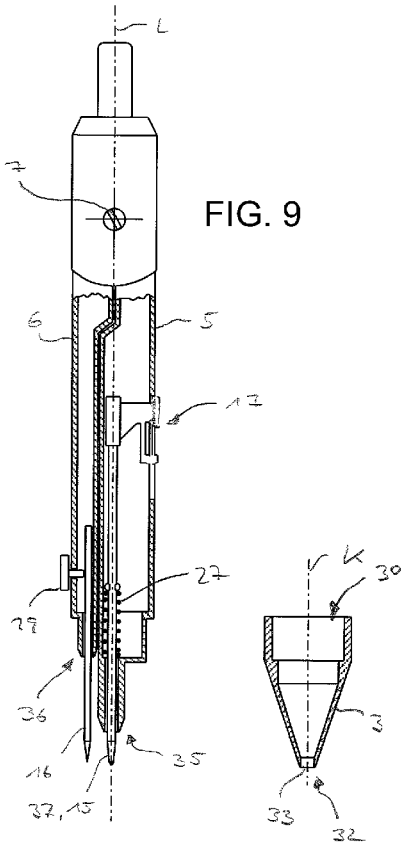
FIG. 9 is a view of the compass pencil in the state shown in FIG. 8, but in the representation shown in FIG. 3.
Figure 10:
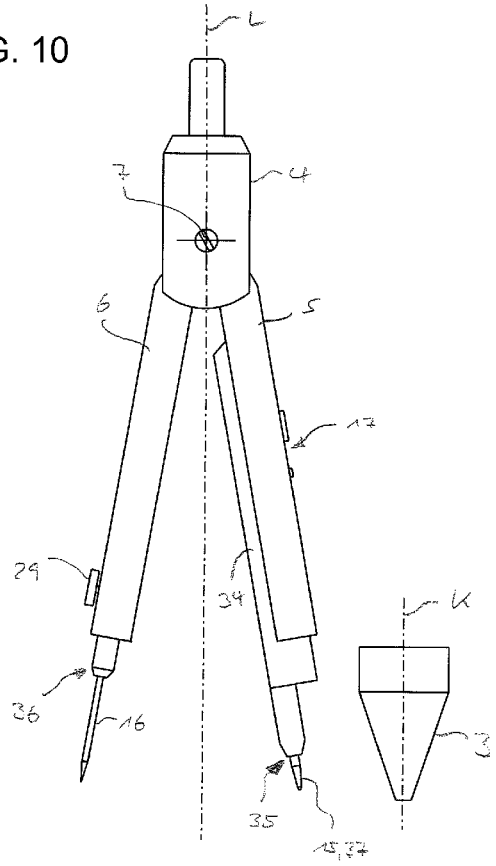
FIG. 10 is a view of the compass pencil in the representation shown in FIG. 1 in the state shown in FIG. 8, but with the compass legs splayed apart.
Figure 11:
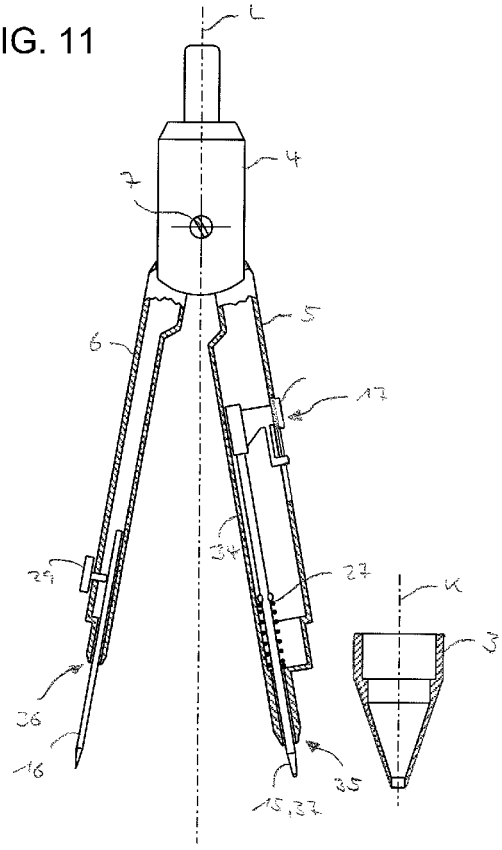
FIG. 11 is a view of the compass pencil shown in FIG. 1 in the state shown in FIG. 10, but in the representation shown in FIG. 3.

In order to use the compass pencil 1 in compass mode, proceeding from the retention state in FIGS. 1 to 3, the protective cap 3 is removed from the compass legs 5 and 6 in such a way that the free ends 35 and 36 and the ends of the writing lead 15 or of the compass tip 16 extending therefrom are accessible from the outside (FIG. 8 and FIG. 9). In order, in compass mode, to be able to orientate the compass pencil 1 in an approximately upright manner with reference to the alignment of its longitudinal axis L, by temporarily releasing the securing screw 29, the compass tip 16 can be advanced until it ends by way of the lead tip 37 approximately at the identical axial height. For compass mode, i.e. for drawing a circular line, the compass legs 5 and 6, as with a normal pair of legs, are pivoted apart until a distance corresponding to the radius of the circle to be drawn is achieved between the end of the compass tip 16 and the lead tip 37. An example of the compass legs 5 and 6 in the splayed-out state is represented in FIGS. 10 and 11.

Figure 13:
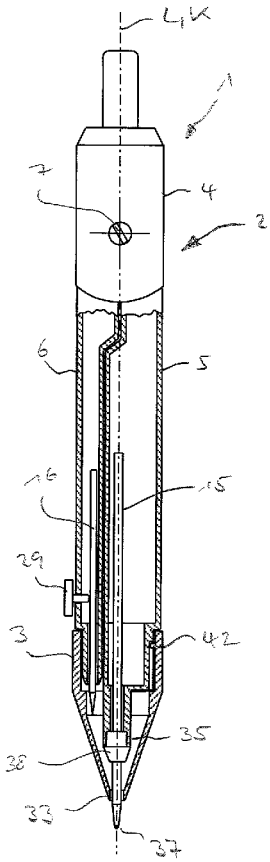
FIG. 13 is a view of the compass pencil shown in FIG. 12 in the representation given there, but in the release state in which the writing lead protrudes out of the protective cap.
Figure 12:
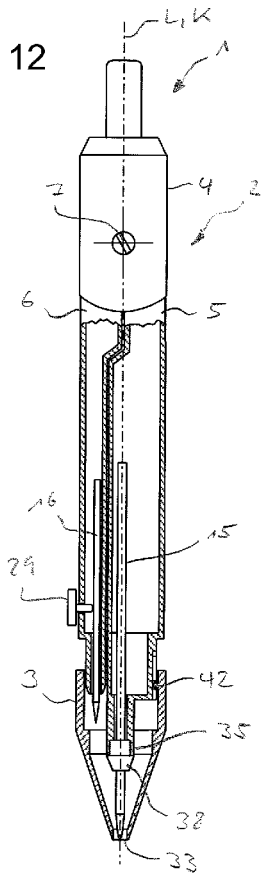
FIG. 12 is a partially broken-away and longitudinal-sectional view of a second embodiment of the compass pencil in the representation shown in FIG. 3, where the writing lead is secured in a fixed manner in the associated compass leg, and where the protective cap in the fitted state is lockable in two longitudinal displacement positions with reference to the compass body, represented in the retention state in which the writing lead is concealed within the protective cap.
Figure 14:
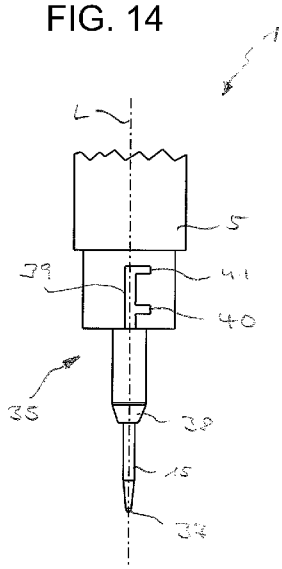
FIG. 14 is a fragmentary, side-elevational view as in FIG. 1 of a portion of the compass body of the compass pencil shown in FIGS. 12 and 13 with the protective cap removed.

A second embodiment of the compass pencil 1 is shown in FIGS. 12 to 14. This embodiment is similar to the first embodiment, in so far as nothing to the contrary is described below. The difference in this embodiment, however, is that in FIGS. 12 to 14 the writing lead 15 is held in a fixed manner, that is to say is not displaceable, in the compass leg 5. To this end an annular projection 38 is mounted in a fixed manner on the writing lead 15 and is inserted by way of a stepped contour in a complementarily formed contour at the free end 35 of the compass leg 5.

In order to be able to adjust the compass pencil 1 between the release state and the retention state in spite of the fixed mounting of the writing lead 15, in the embodiment of FIGS. 12 to 14 the protective cap 3, in the fitted state, is lockable to the compass body 2 in two longitudinal displacement positions with reference to the compass body. One displacement position of the protective cap 3 corresponding to the retention state, in which the protective cap is only partially fitted onto the compass legs 5 and 6, is represented in this case in FIG. 12. A further displacement position that corresponds to the release state, in which the protective cap 3 is completely fitted onto the compass legs 5 and 6, is represented in FIG. 13.

The dual locking capability of the protective cap 3 on the compass body 2 is achieved through the use of a modified bayonet closure. To this end, an axial guide groove 39 with two tangential protrusions 40 and 41 that are spaced apart is provided at the free end 35 of the compass leg 5. A guide projection 42 protruding radially inward is integrally formed in the interior of the protective cap 3. The guide projection runs in the guide groove 39 when the protective cap 3 is fitted. In order to lock the protective cap 3 in the longitudinal displacement position corresponding to the retention state (FIG. 12), the guide projection 42, in this case, is pivoted into the protrusion 40. In order to lock the protective cap 3 in the longitudinal displacement position corresponding to the release state (FIG. 13), the guide projection 42 is pivoted into the protrusion 41.

Figure 15:
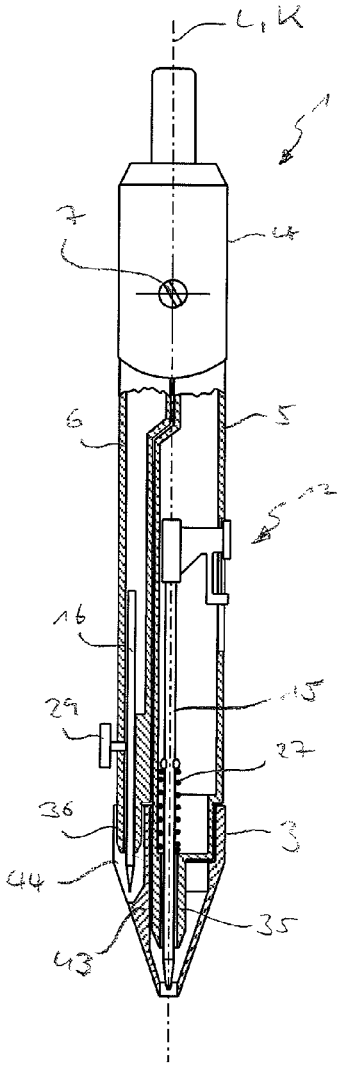
FIG. 15 is a partially broken-away and longitudinal-sectional view of another embodiment of the compass pencil in the representation shown in FIG. 3, where the compass legs can be splayed apart with the protective cap fitted.
Figure 16:
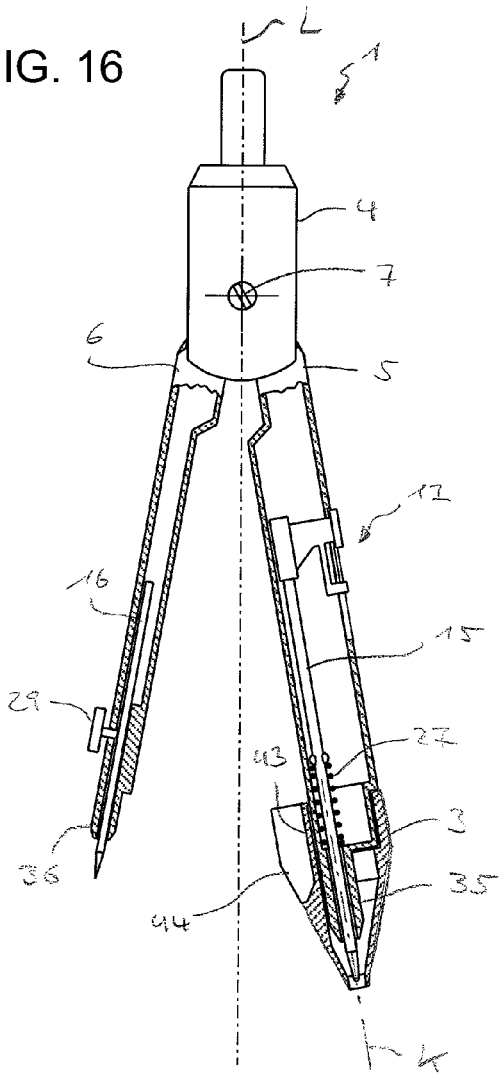
FIG. 16 is a view of the compass pencil shown in FIG. 15 in the representation shown in FIG. 11 with the compass legs splayed apart.

A third embodiment of the compass pencil 1 is shown in FIGS. 15 and 16. This third embodiment is also similar to the first embodiment, barring the differences named below. Thus, in this case, unlike the protective cap 3 of the previously described embodiments, the protective cap 3 has an intermediate wall 43 that, in the fitted state of the protective cap 3, engages between the free end 35 and the free end 36 of the compass legs 5 and 6. The protective cap 3, in this case, is strictly fitted just onto compass leg 5 and therefore, in the fitted state, assumes a force-locking or form-locking connection just with the compass leg 5 holding the protective cap 3 on the compass body 2. A force-locking connection is one which connects two elements together by force external to the elements, as opposed to a form-locking connection which is provided by the shapes of the elements themselves. Contrary to this, the compass leg 6 is not mechanically coupled to the fitted protective cap 3, but rather the free end 36 of the compass leg 6 in the closed state is loosely enclosed in the interior of the protective cap 3, in such a way that the free end 36 and the compass tip 16 protruding beyond the free end are protected against contact. On the side facing the compass leg 6, the protective cap 3 is provided with a lateral opening 44, through which the compass leg 6 is pivotable between the closed state and the splayed state without the protective cap 3 having had to be removed for this purpose.

Figure 17:
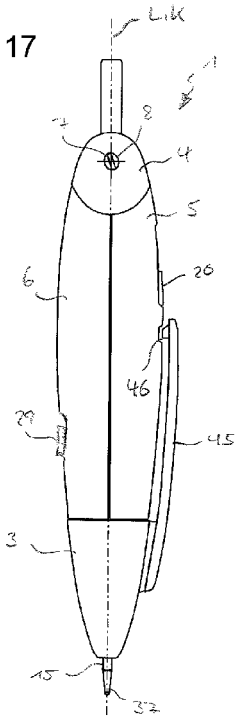
FIGS. 17 to 22 are views of two further embodiments of the compass pencil as shown respectively in FIG. 2, FIG. 3 and FIG. 11, where the compass legs in the closed position together with the fitted protective cap form a rounded outer contour.
Figure 18:
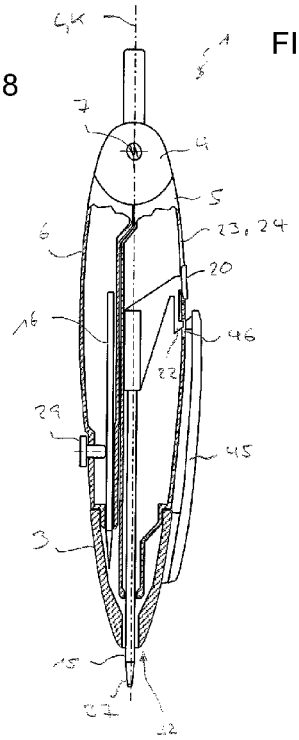
Figure 19:
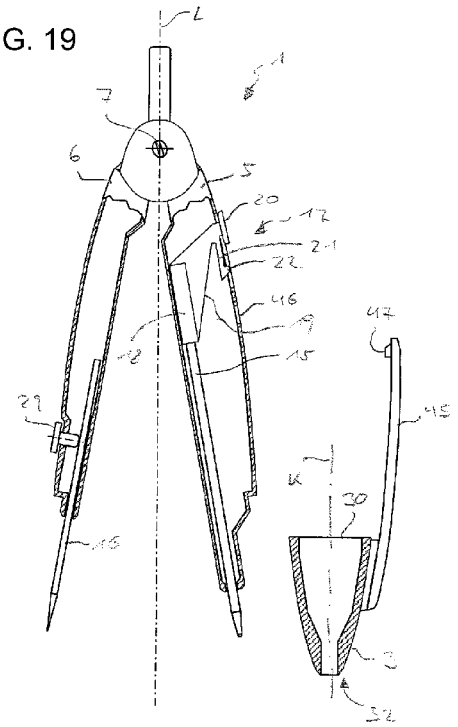

A fourth embodiment of the compass pencil 1 is represented by way of FIGS. 17 to 19. This embodiment of the compass pencil 1 also corresponds substantially to the first embodiment. Unlike that embodiment, however, the compass legs 5 and 6 together with the protective cap 3 form an ergonomically rounded outer contour that corresponds, for instance, to an elongated oval. Unlike the first embodiment, a securing clip 45 is also integrally formed on the protective cap 3, as is usual generally, for example, in the case of ballpoint pens in order to secure them in a jacket pocket or the like. The securing clip 45 protrudes in the direction of the cap axis K beyond the top opening 30 and, in the fitted state of the protective cap 3, runs closely along the outer contour formed by the closed compass legs 5 and 6.

The cross section of the top opening 30 is developed, in particular, in a noncircular manner in such a way that the protective cap 3 can only be fitted onto the compass legs 5 and 6 in a specific rotational position. That rotational position is selected, in particular, in such a manner that the securing clip 45 flanks the compass leg 5 in an approximately central manner.

In the case of the embodiment of FIGS. 17 to 19, in addition it is not possible, for unlocking purposes, to pivot the locking hook 22 of the ballpoint pen mechanism 17 out in a tangential manner but rather in a radial manner. The locking hook 22, in this case, interacts with an opening 46 in the wall of the compass leg 5 to lock the ballpoint pen mechanism 17. The securing clip 45, in this case, is dimensioned in such a manner that, with the protective cap 3 fitted, an inwardly protruding holding projection 47 located at the free end of the securing clip comes to rest precisely above the opening 46. The holding projection 47 is additionally dimensioned in such a manner that, with pressure exerted radially inwards onto the securing clip 45 of the fitted protective cap 3, the holding projection 47 engages in the opening 46 and unlocks the locking hook 22 possibly held in this case. This means, therefore, that the securing clip 45 can be used to reset the ballpoint pen mechanism 17 in a simplified manner.

A return spring, which is not shown in FIGS. 18 and 19 for reasons of simplification, is also provided in this embodiment for resetting the writing lead 15.

Figure 20:
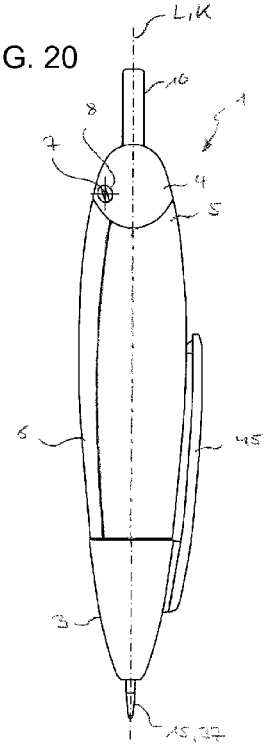
Figure 21:
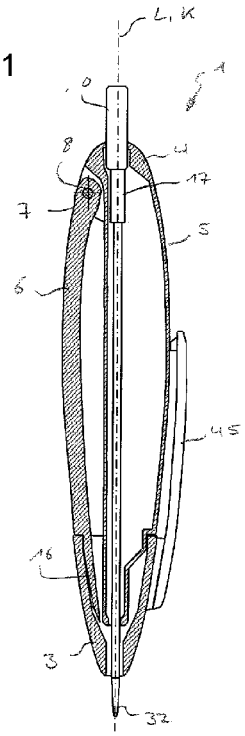
Figure 22:
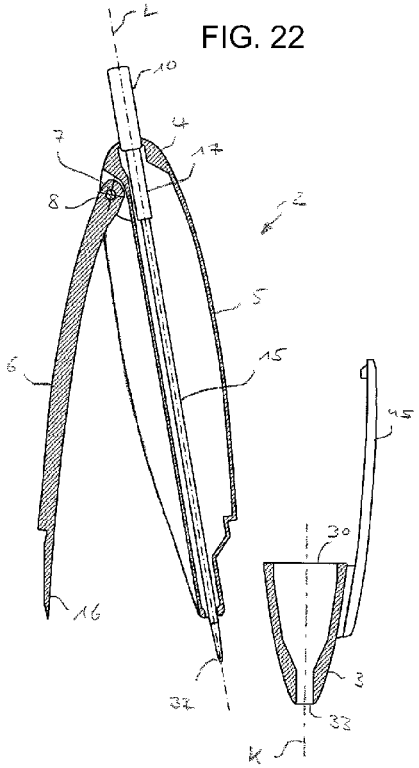

A further embodiment of the compass pencil 1 is represented in FIGS. 20 to 22. This embodiment corresponds substantially to the last described embodiment. Unlike that embodiment, however, the compass tip 16 in FIGS. 20 to 22 is located in a fixed manner, in particular is integrated in one piece on the compass body 6. The ballpoint pen mechanism 17 (only roughly illustrated), in this case, is developed in the manner of a conventional push-push mechanism. The grip projection 10 that, in this case, is correspondingly guided in a longitudinally displaceable manner in the holder 4, serves as an actuating member of the ballpoint pen mechanism 17. In order to enable simple coupling between the ballpoint pen mechanism 17 and the writing lead 15, in this case, the holder 4 is connected in one piece, and consequently in a rigid manner, to the compass leg 5. The compass leg 6 is pivotally mounted in an eccentric manner with reference to the longitudinal axis L through the use of the securing screw 8 on that unit, which is formed by the holder 4 and the compass leg 5.

The return spring has also been omitted in FIGS. 20 to 22 purely for reasons of simplification.

The securing screw 8, in this case, is preferably provided on its head with a grip contour, for example in the form of a protruding web or the like, in such a way that it can be tightened and loosened manually in a reversible manner in order to secure the compass leg 6 in a predetermined angular position with reference to the compass leg 5 or in order to enable simple pivoting of the compass legs. A rubber sleeve or a serrated or resilient washer is preferably positioned underneath the securing screw 8 in order to improve the reciprocal securement of the compass legs 5 and 6 once the securing screw has been tightened.

In the case of all of the embodiments of the compass pencil 1 described above, the writing lead 15 can also be securable, similar to the compass tip 16 in the case of the embodiments of FIGS. 1 to 19, in different longitudinal displacement positions with reference to the compass leg 5, through the use of a simple clamping mechanism. In the case of all of the embodiments of the compass pencil 1, the writing lead 15 can also be replaced by a pencil or crayon lead or a felt or fiber pen cartridge. In the first case, the ballpoint pen mechanism 17 is expediently replaced by a feed mechanism for the pencil or crayon lead that is normal for a mechanical pencil or fine tip pencil.

The invention claimed is:

1. A compass writing implement, comprising:

a compass body including two compass legs having free ends and being mounted pivotably relative to one another between a closed state and a splayed-out state;

a writing lead held on one of said compass legs and having a lead tip; and a protective cap fitted or to be fitted onto said free end of at least said ends of both of said compass legs for shielding and securing said compass legs from the outside in said closed state with said protective cap;

said protective cap having an interior, a distal end remote from said compass body in a fitted state and a passage in said distal end for said writing lead; and said writing lead and said fitted protective cap being displaceable relative to one another between:

a release state in which said lead tip of said writing lead projects through said passage to the outside, and a retention state in which said writing lead is retracted in said interior of said protective cap.

2. The compass writing implement according to claim 1, wherein said protective cap is fixedly held on said compass body in said fitted state, and said writing lead is displaceable in said compass leg holding said writing lead when said protective cap is fitted.

3. The compass writing implement according to claim 2, which further comprises a feed mechanism for said writing lead being integrated in said compass leg holding said writing lead.

4. The compass writing implement according to claim 1, wherein said protective cap is configured to be locked to said compass body, in said fitted state, in two longitudinal displacement positions corresponding to said release state and said retention state.

5. The compass writing implement according to claim 1, wherein said compass legs are configured to be splayed apart out of said closed position, with said protective cap fitted.

6. The compass writing implement according to claim 1, wherein said writing lead is a ballpoint pen cartridge or is produced from an abrasive material.

7. The compass writing implement according to claim 1, wherein said compass body has a longitudinal axis, and said writing lead is oriented approximately coaxially to said longitudinal axis of said compass body in said closed state of said compass legs.

8. The compass writing implement according to claim 1, wherein said compass body has a longitudinal axis, and said compass legs are coupled to only permit them to be splayed out in a symmetrical manner by identical angles relative to said longitudinal axis of said compass body.

9. The compass writing implement according to claim 1, wherein said protective cap tapers towards said distal end.

10. The compass writing implement according to claim 1, wherein said compass legs, in said closed state, together with said fitted protective cap, form an outer contour being rounded off approximately in an elongated oval or spheroid shape.

11. A compass writing implement, comprising:

a compass body including two compass legs having free ends and being mounted pivotably relative to one another between a closed state and a splayed-out state;

a writing lead held on one of said compass legs and having a lead tip; and a protective cap fitted or to be fitted onto said free end of at least said compass leg holding said writing lead for shielding at least said free end from the outside in said closed state;

said protective cap having an interior, a distal end remote from said compass body in a fitted state and a passage in said distal end for said writing lead;

said writing lead and said fitted protective cap being displaceable relative to one another between:

a release state in which said lead tip of said writing lead projects through said passage to the outside, a retention state in which said writing lead is retracted in said interior of said protective cap; and a securing clip located on said protective cap and pointing to said compass body.

12. The compass writing implement according to claim 11, wherein said securing clip has a free end with an inwardly projecting holding projection lying above an opening in one of said compass legs.

* * * * *